US005087037A

United States Patent [19]

Morrow

[11] Patent Number: 5,087,037

[45] Date of Patent: Feb. 11, 1992

[54] PNEUMATICALLY ELEVATING RECREATIONAL EXERCISE DEVICE

[76] Inventor: George S. Morrow, 28533 Via Las Flores, Murrieta, Calif. 92362

[21] Appl. No.: 689,112

[22] Filed: Apr. 22, 1991

Related U.S. Application Data

[63] Continuation-in-part of Ser. No. 524,324, May 14, 1990, abandoned.

[51] Int. Cl.[5] ..... A6B 9/00

[52] U.S. Cl. ..... 272/110; 272/114; 272/66; 272/113; 272/70.1

[58] Field of Search ..... 272/65, 110, 114, 130, 272/131; 623/28

[56] References Cited

U.S. PATENT DOCUMENTS

| | | | |
|---|---|---|---|
| 2,212,460 | 8/1940 | Stephenson | 272/65 |
| 2,865,633 | 7/1956 | Woodall | 272/114 |
| 3,181,862 | 5/1965 | White | 272/57 |
| 3,351,342 | 11/1967 | Guin | 272/57 |
| 3,365,194 | 3/1965 | Stickland | 272/110 |
| 4,632,371 | 2/1986 | Wirges et al. | 272/114 |

*Primary Examiner*—Robert Bahr
*Assistant Examiner*—J. Donnelly
*Attorney, Agent, or Firm*—David Pressman

[57] ABSTRACT

A pneumatically elevating recreational exercise device that utilizes in its preferred embodiment a commercially manufactured air cylinder (12) as an extendable air spring that is secured, or fixed to a horizontal surface or stand. A safety harness attachment (51) for securing a body harness is also provided. The device produces dramatic extension, or elevating capacity for vertical rebounding movement, and is entirely self-contained. An aspirating check-valve (10) is used to admit air at the top of the stroke, which produces added elevation with each vigorous leaping effort. This concept is also applied to an unsecured toy pogo stick embodiment.

20 Claims, 9 Drawing Sheets

PNEUMATICALLY ELEVATING RECREATIONAL EXERCISE DEVICE

This is a continuation-in-part of completed application Ser. No. 524,324, filed on May 14, 1990 now abandoned.

BACKGROUND

1. Field of Invention

This invention relates to pogo stick type exercising devices, and specifically to those that use a pneumatic cylinder as an air spring.

2. Description of Prior Art

Pneumatic air cylinder technology is a well known and highly developed art due to extensive use in many industrial applications. For this reason, modern air cylinders are both reliable and durable, with life expectancies commonly measured in the millions of cycles. It therefore seems reasonable to apply this technology to exercise equipment, and particularly to rebounding devices.

Pogo sticks are a well known recreational toy. During this century, patents in this field have described numerous methods of obtaining a higher or more controllable leap. Most of these have involved complicated mechanisms which raise questions as to their reliability as well as high costs to produce.

One example of a pneumatic pogo stick is found in U.S. Pat. No. 4,632,371 issued to Wirges, et al., Dec. 30, 1986, and names over 200 parts. Of a similar nature is U.S. Pat. No. 3,351,342 granted to Guin Nov. 7, 1967. Each of these patents provides a pogo stick that uses a pneumatic "air spring" with a biasing force that is variable. Other than complexity and obvious expense to build, both these patents share another shortcoming: their designs allow for varying only the biasing force, and have no provision for variation of the elevation, or extendability of the air spring.

One U.S. patent attempts to address the problem of variable height control, but does so in a very limited way. U.S. Pat. No. 3,181,862 (White, May 4, 1965) describes a pogo stick of great mechanical complexity that uses a rack and sprocket to raise or lower the mechanism, one tooth per jump, for a total extension of about 50 centimeters (20 in.). Presumably, this limited extendability is due to limitations of design as well as necessary skills required to operate without damaging the device or the operator. The skill factor here is important, as it also brings up the question of safety.

The safety issue has become increasingly important in recent times due to the legal climate of more lawsuits and greater awards. Any marketing venture that fails to recognize this factor is therefore in danger of commercial failure. Prior patents in the pogo stick field have, for the most part failed to address this issue. There is an element of danger inherent in devices that enable people to be propelled into the air without restraint. Heretofore, a certain degree of skill was assumed in order for the operator to safely complete a series of jumps. Good judgment was also required in selecting terrain, surface conditions, etc., as well as an awareness of people, vehicles, or other hazards in the area. Also, the device itself could be an additional hazard, the more so if heavy, or prone to uncontrolled flight when the operator fell off.

I have found no prior art that uses a stationary, or secured version of a pogo stick to overcome these problems. Additionally, sharp or unpadded surface could be especially dangerous in pogo sticks that are short enough to allow the head of the rider to extend above the top of the device. This would expose the head, face, and neck to serious injury should the feet slip from the footrests, or the knees flex during recoil. This shortcoming appears to be present in two, of not all three of the above cited references.

OBJECTS AND ADVANTAGES

Accordingly, several of the objects and advantages of my invention are:

(a) to provide a pogo stick exerciser that is simple of design and easy to produce, (b) to provide such a device which will extend, and thus elevate during use, or elevated to a substantial or exhilarating degree, (c) to provide such a recreational device that is inexpensive and lightweight so as to be affordable and safe to use as a toy pogo stick for children or adults, (d) to also provide such a recreational device with a mechanism in common industrial use (air cylinder technology) so as to have proven reliability, efficiency, and durability, (e) to provide such a recreational device with (infinitely) variable height control, and with the maximum attainable height (extension) limited only the size of the equipment, (f) to provide such a recreational exercise device that is safe to use, in that it is secured ground (to floor or stand); and additionally, a safety-harness attachment that may be utilized so that the operator cannot fall off, (g) to provide such an exercise device that has the physical benefits of a rebounder, and is capable of adjustment to any degree of effort required for sustainable (aerobic) exercise, and (h) to provide such an exercise device that, in addition to providing exercise for the lower extremities, involves the arms and upper body to as great a degree as desired by the operator.

Further objects and advantages are to provide a health-promoting recreational exercise suitable for amusement facilities, where desires for both competition and sociability can be enhanced by having several of these devices set up adjacent to each other. In such a setting, it can be seen that this machine will lend itself to many healthy competitions such as seeing who can gain the most elevation in the least time, etc. Also, such an aerobic device that is fun, yet safe to operate without supervision would provide formidable competition to the numerous stationary bicycles and stair-machines that are the mainstays in modern gyms and health clubs. Still further objects and advantages of this invention will becomes apparent from a consideration of the drawings and ensuing description.

REFERENCE NUMERALS IN DRAWINGS

Figure 1A:
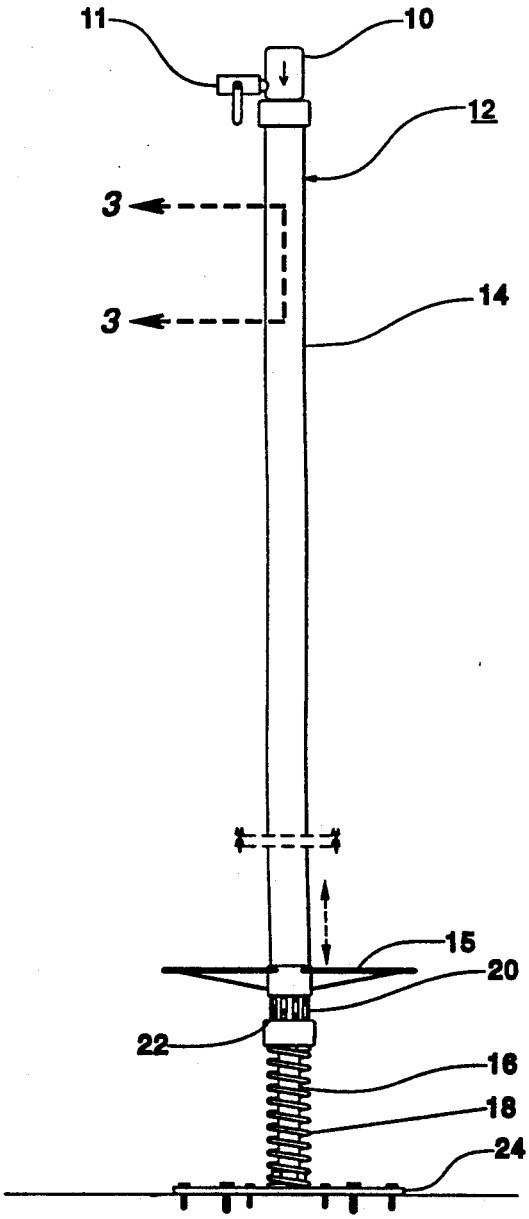
FIGS. 1A and 1B show similar perspective views of a pogo stick according to a basic embodiment of the invention, FIG. 1A being in the starting position, and FIG. 1B being in a substantially extended position.

10: check-valve, aspirating
11: bleed-valve
12: pneumatic air cylinder
13: cylinder piston
14: cylinder barrel
15: footrest
16: rod (plunger)
17: working (primary) air chamber
18: limiting spring
19: secondary air chamber
20: relief porting
22: bumper spring (interior)
24: mounting plate
26: mounting nut
28: weld (nut to plate)
30: mounting bolt
32: "double end" air cylinder
34: rod (upper end)
36: wall mounting bracket
38: stop-valve, tank outlet
40: stop-valve, tank inlet
42: check-valve, tank outlet
43: check-valve, tank inlet
45: air pressure gage
48: tank retaining strap
50: air (reservoir) tank
51: harness attachment ring
52: handhold
54: check-valve, secondary
56: barrel tube
57: PVC pipe bushing (glued)
58: plunger tube
60: end-tip (hard surface)
62: alternate end-tip (soft)
64: PVC pipe plug (glued)
66: "U-cup" ring seal
70: check-valve control lever
72: footrest platform
74: stop-collar
76: stand pipe
78: receiving tube
80: concrete footing (optional)
82: lat-pull bar
84: body harness
86: safety/dip-rail.

DESCRIPTION—FIGS. 1-3

Figure 1B:
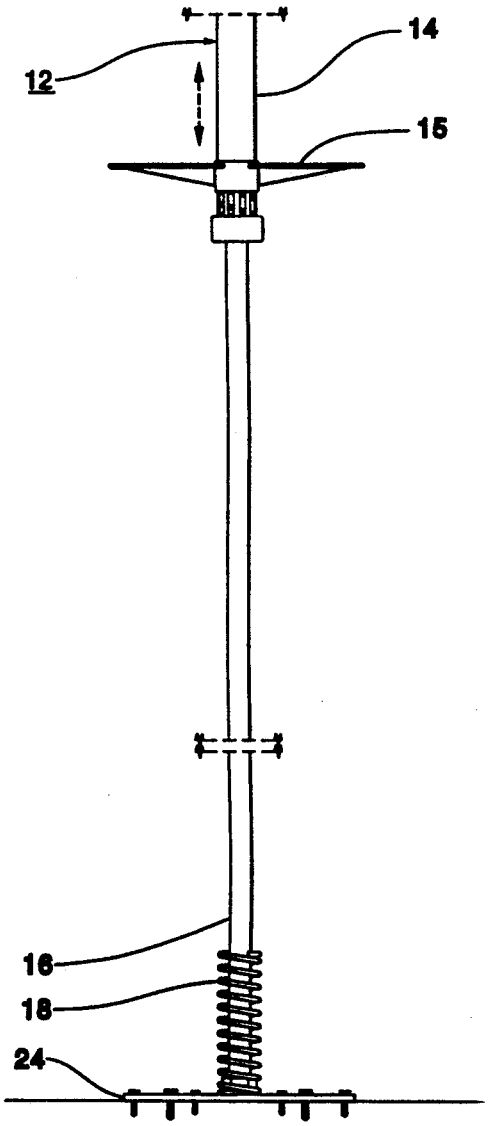
Figure 2:
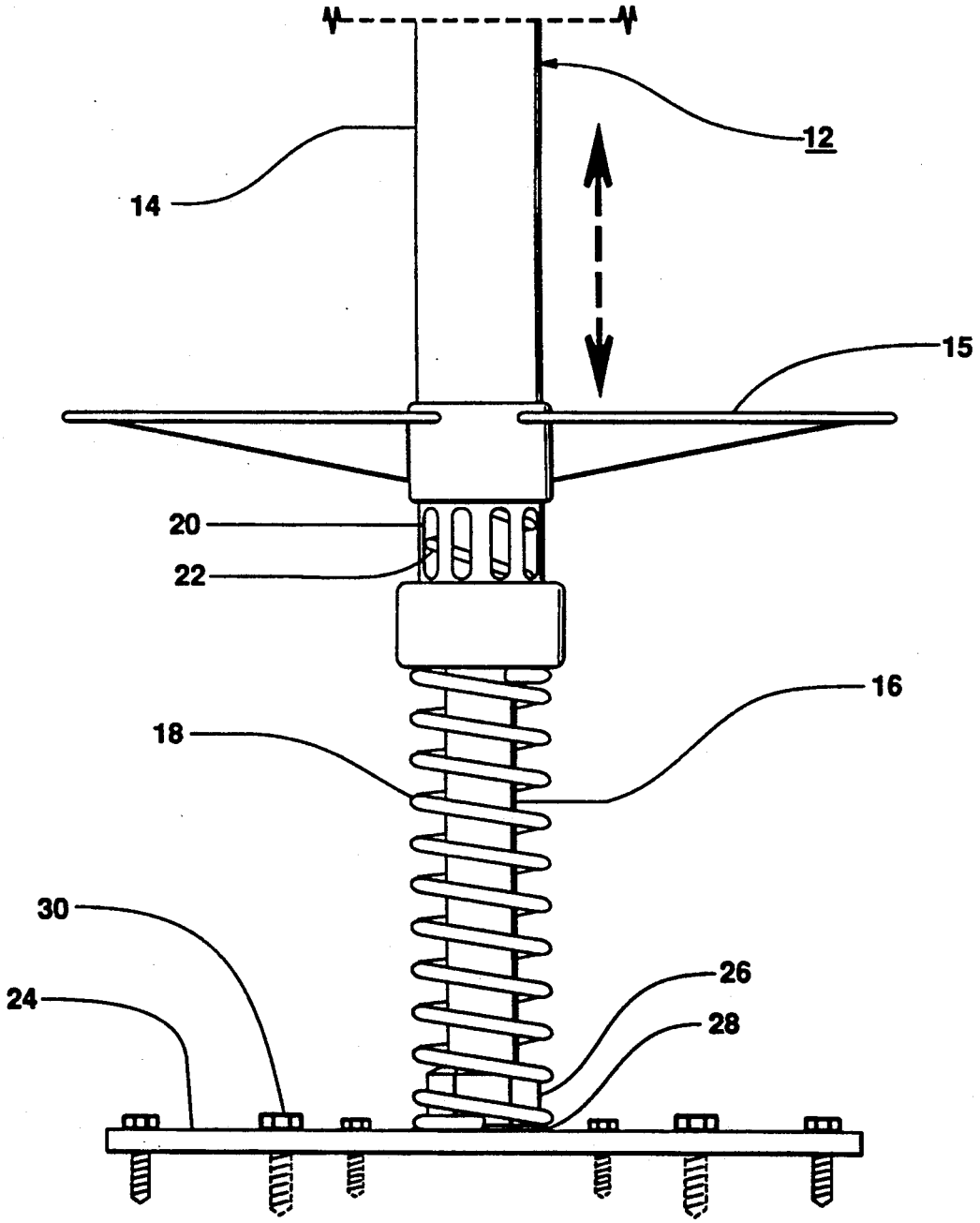
FIG. 2 shows the bottom portion of the pogo stick of FIG. 1A in more detail.

FIGS. 1 and 2 show perspective views of a basic embodiment of the "secured", or fixed-rod version of my invention; it uses a commercially manufactured air cylinder 12 with a stout 38 mm. (1½ in.) diameter rod 16.

FIG. 1B shows the device in the resting or starting position. It uses a cylinder with a 210 cm. (7 ft) stroke length and a 76 mm. (3 in.) bore diameter. The top portion of the figure shows an aspirating check-valve 10 mounted by conventional means (threaded) into the cylinder. As is common with this type of unidirectional valve, an arrow on the valve body shows the direction of flow. The arrow on this particular valve 10 properly shows it to be faced into, or toward the cylinder with a bleed-valve 11 mounted into a tapped hole on the "pressure side", or outlet half of the check-valve. For the capacity cylinder shown, a 6.3 mm. (¼ in.) ball valve was used, tapped into a 19 mm. (¾ in.) spring type check-valve.

All valves, ports, and plumbing specified are standard U.S. NPT (National Pipe Thread) sizes.

FIG. 1B shows the very same device in the substantially, or nearly extended position. Both FIGS. 1A and 1B show footrest 15 attached to the lower portion of cylinder barrel 14. Although the method of mounting the footrest is optional, and might include band clamps or set-screws, etc., it is not advised to weld anything to the barrel on this type of cylinder for fear of distorting the inner surface which has been finely honed and chromium plated; however, welding could be used before the honing and plating as a manufacturing process. I have chosen to use a ring of epoxy adhesive to support the footrest on my prototypes, which also renders the footrest movable and adjustable. Further details of construction are best shown in FIG. 2.

FIG. 2 shows the lower portion of the device with particular attention to spring and mounting details. Cylinder rod 16 is secured by being threaded into a hardened unit 26 which is in turn welded to mounting plate 24 at weld 28. Six mounting bolts 30 are shown, which are used to fix the device to floor, stand or other secure horizontal surface. In the resting or "fully bled" position shown, the air cylinder barrel is supported by a limiting spring 18. Since this spring is used as both a "start-up" and a "bottom-out" spring, it must be of a capacity to stop a weight of approximately 135 kg. (300 lb.) from a free fall of the full stroke length (210 cm. or 7 ft.) before "bottoming out". At the bottom of the cylinder and inside the barrel, an interior bumper spring 22 may be seen through relief porting 20 slots. Although the interior spring is optional, it is advisable to have some resilient means located between the piston and lower head of the air cylinder to prevent excessive shock when barrel "tops out" against bottom of piston. The means used should be appropriate for the amount of such shock anticipated, according to the size, as well as other design options to be discussed later.

Figure 3:
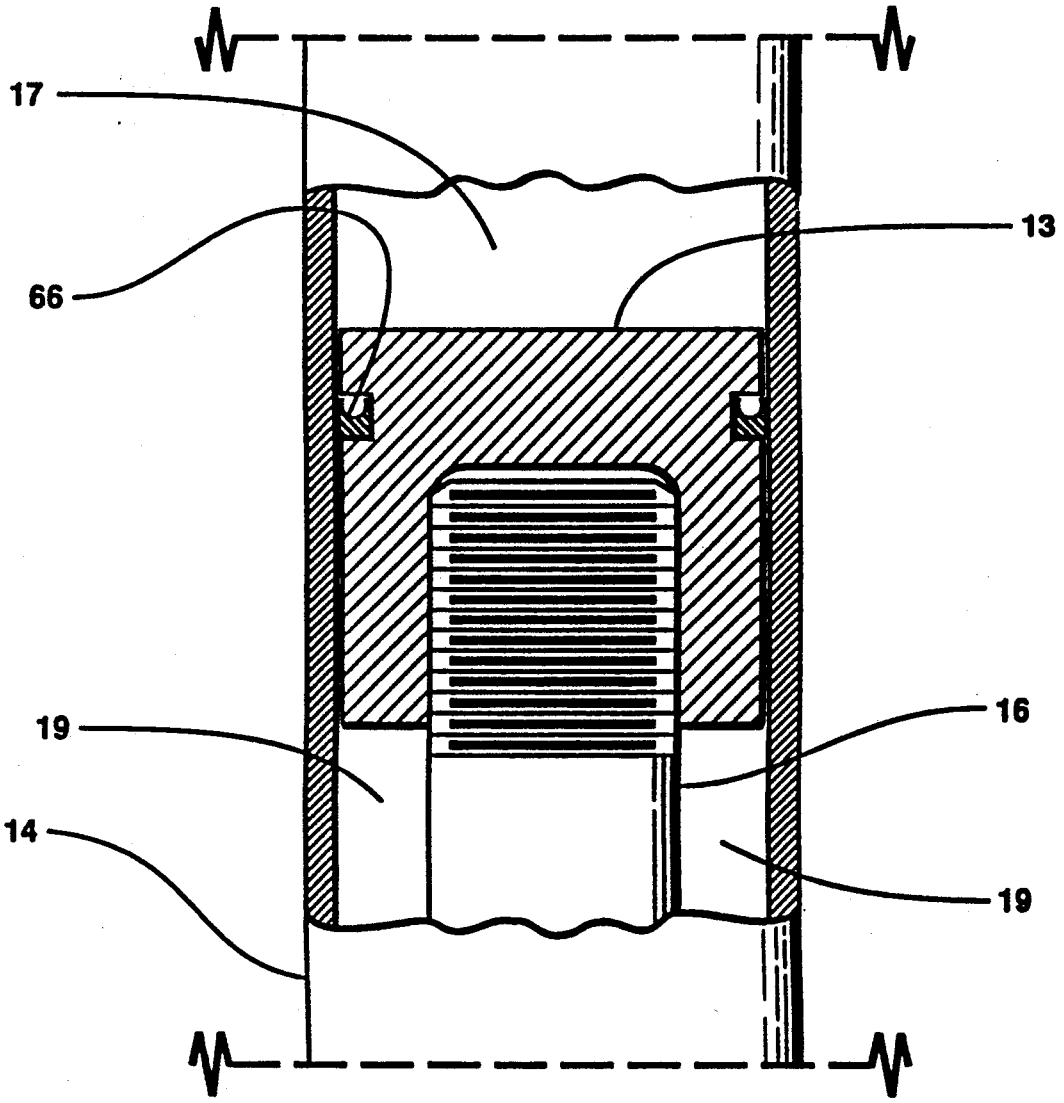
FIG. 3 shows an interior (piston) detail of the portion of an air cylinder indicated by section lines 3—3 in FIG. 1A.

FIG. 3 is a sectional view of the portion of air cylinder 12 occupied by piston 13 which is fitted with a typical "U-cup" seal 66. This view also shows working air chamber 17 and secondary air chamber 19. Though rod 16 is shown to be threaded into the piston in this rendering, these and other details of the air cylinder construction are optional.

DESCRIPTION—FIG. 4

Figure 4:
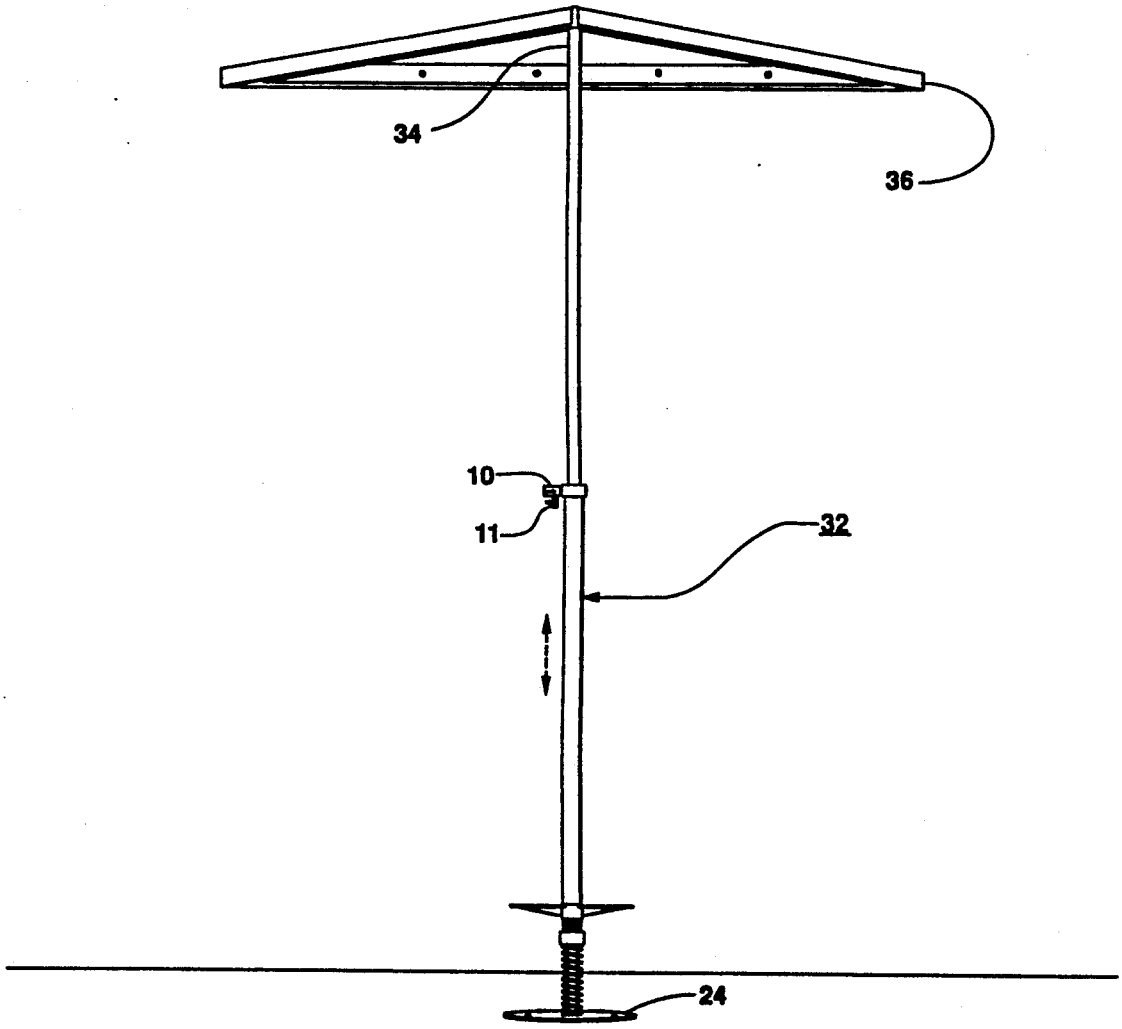
FIG. 4 shows a perspective view of an embodiment using a so-called "double end" type air cylinder with a wall mounting bracket.

FIG. 4 shows a similar embodiment, except that it uses a so-called "double end" air cylinder 32 in order that the rod may be secured at the top as well as the bottom. The upper end of rod 34 is secured to a nearby wall by a wall mounting bracket 36. It could be similarly attached to ceiling, beam, or any other suitable element. With mounting plate 24 bolted to the floor, it can be seen that the bending stress on the lower mounting is all but eliminated. The only other change involved in this embodiment is in the upper cylinder head. Since the upper half of the rod now extends through this head, it is necessary to mount aspirating valve 10 by porting it into the side of the head as shown, with bleed valve 11 mounted to it as before.

DESCRIPTION—FIG. 5

Figure 5:
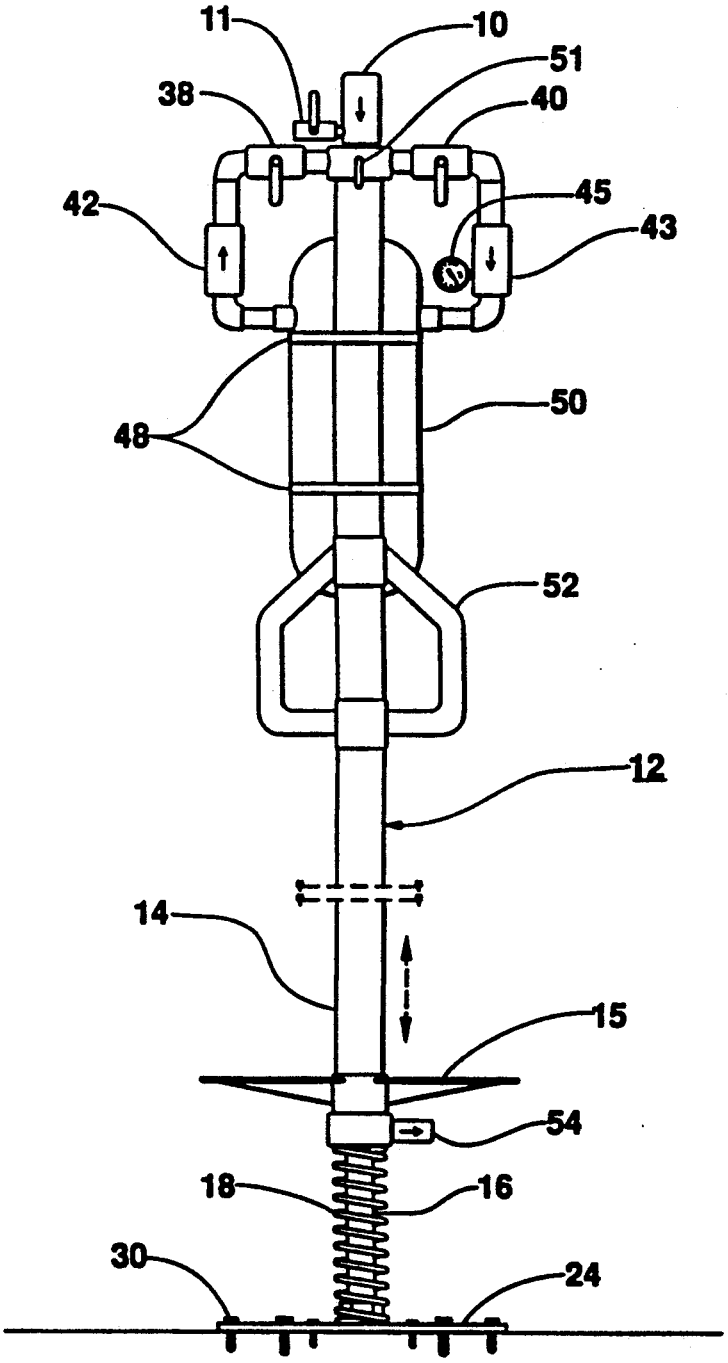
FIG. 5 shows a perspective view of the present preferred embodiment with an air reservoir tank set-up, a harness attachment ring, handholds, and a lower (secondary chamber) check-valve.

FIG. 5 shows a perspective view of the preferred embodiment of the machine. It incorporates all the same components, specifications, and mounting details of the basic embodiments shown in FIGS. 1 and 2, excepting the following. The only changes in the basic air cylinder 12 involve the porting configuration: Two valve ports have been added to the upper head, on opposite sides, to accommodate connections to an air reservoir tank to be described below. The other change involves the porting of the lower, or secondary air chamber 19. The relief porting slots (20—FIG. 2) have been omitted and a single valve port in the bottom head now accommodates a 13 mm. (½ in.) check-valve 54. This check-valve is "facing" in an outward direction from the cylinder as the arrow on its body indicates. This is for the purpose of evacuating the secondary air chamber and will be discussed later under the "Operation" heading.

Another change to this embodiment is the addition of an air tank 50 and associated plumbing. The tank itself may be light in weight, as it need only hold a maximum of approximately 5 atmospheres (75 psi.). The assembly is also of a simple and conventional nature, consisting of identical plumbing on inlet and outlet sides, the only difference being the direction of air flow dictated by check-valves 42 and 43. Common ball valves are used for stop-valves 38 and 40 and are shown positioned nearest the cylinder head to provide "IN/OUT" control and to prevent undue reduction or air compression in the cylinder. All valves and plumbing shown in this assembly are 19 mm. (¾ in. NPT), with the exception of air pressure-gage 45, which has a standard (6.5 mm (¼ in.) thread. Additional support to the tank is provided by two tank-retaining straps 48. This embodiment also includes a harness attachment ring 51 in the form of an 8 mm. (5/16 in.) eye bolt threaded into the upper head. This is for the purpose of attaching an optional body harness (not shown) for added safety, or in commercial situations. The final addition consists of handhold 52, which is supported on the barrel in similar manner as described above for the footrest (i.e., by an epoxy bead, etc.).

DESCRIPTION—FIGS. 6 AND 7

Figure 6:
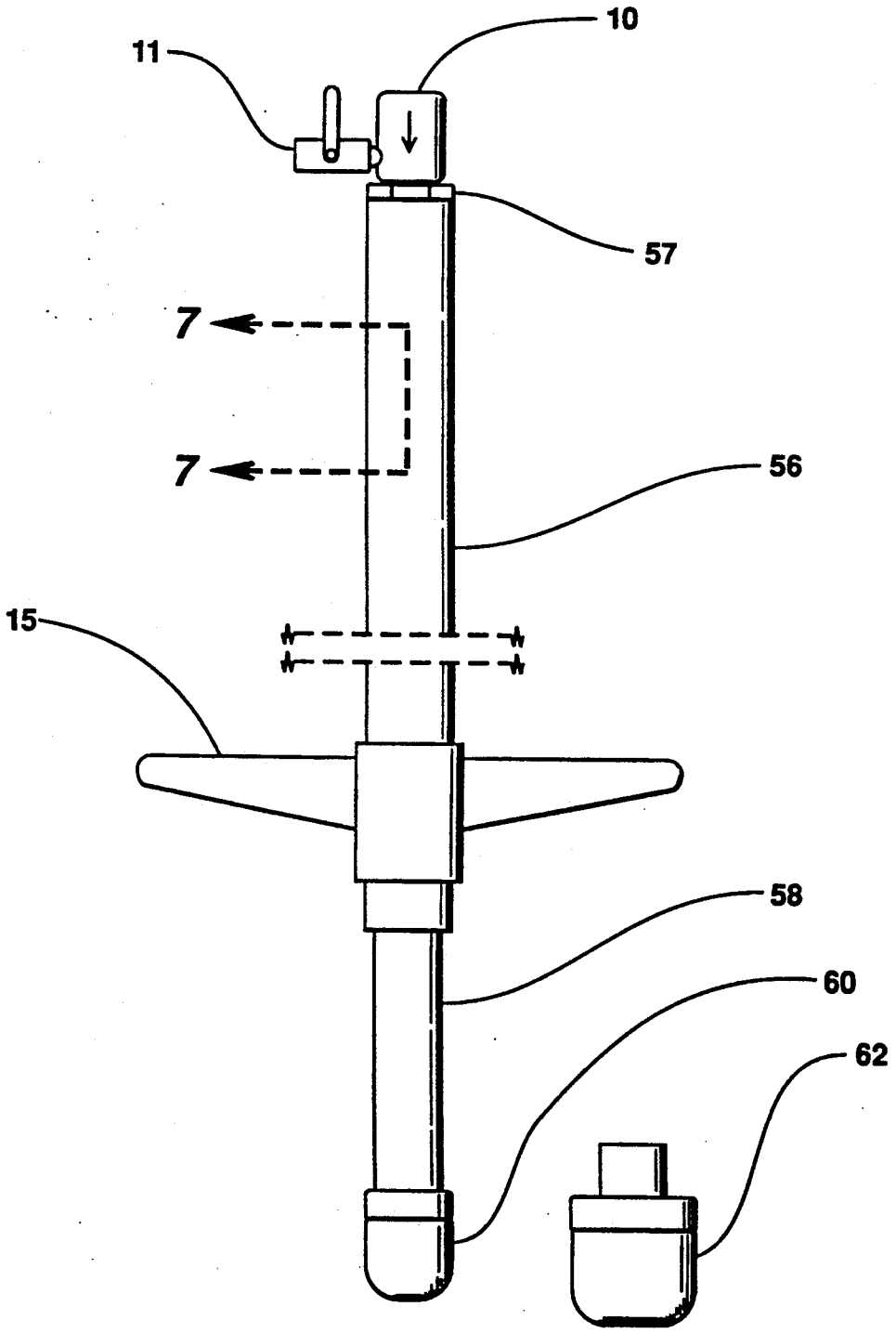
FIG. 6 shows a lightweight, toy pogo stick embodiment.

FIG. 6 shows a simplified and lightweight toy, or unsecured pogo stick version. Although the materials are optional and subject to change, PVC tubing is the current preference as it allows for ease of assembly (the components may be glued) and is inexpensive as well as light in weight. The embodiment shown uses 76 mm. (3 in.) "schedule 80", or thick-wall PVC tubing for a barrel tube 56 which is approximately 183 cm. (6 ft.) in length. A similar material is used for plunger tube 58 of the same length (6 ft.), but in a 64 mm. (2½ in.) size so that it slides easily inside the barrel tube. The barrel tube has an adapter bushing 57 glued into it at the top to accommodate check-valve 10 facing inward as shown, which in turn accommodates bleed-valve 11 on the down stream, or pressure side of the check-valve as on previous versions. Footrest 15 may supported by an adhesive bead or band as in previously mentioned embodiments or glued directly to the barrel if so desired. The lower terminus of plunger tube 58 is capped by an end-tip 60 of a resilient or rubberoid material that is sized to fit tightly into the end of the tube. Alternate end-tip 62 shown directly to the right may be used to replace end-tip 60 when a larger ground-engaging area is desired for use on soft surfaces such as lawns or sand.

Figure 7:
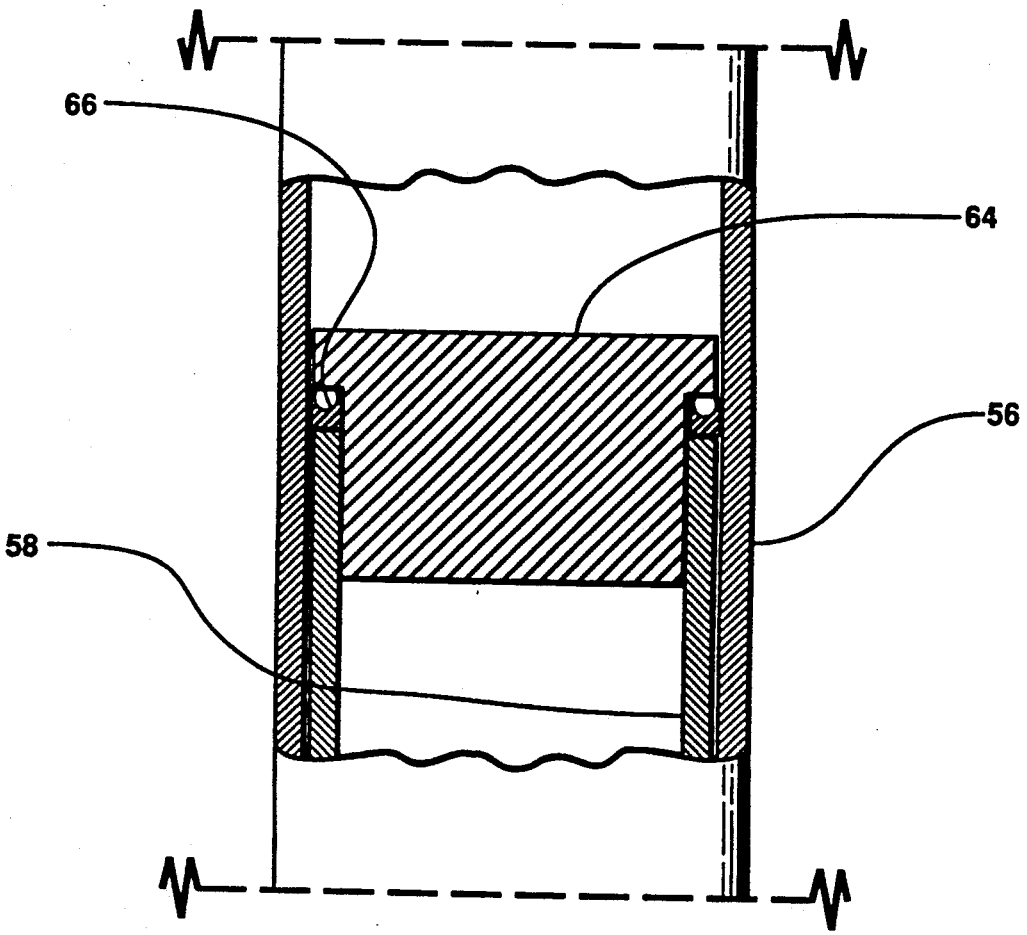
FIG. 7 shows an interior detail of the toy pogo stick, indicated by section lines 7—7 in FIG. 6.

FIG. 7 shows the inner details of the portion indicated by the section lines 7—7 in FIG. 6. This sectional view shows the top end of the plunger tube 58 telescoped inside the barrel tube. A PVC pipe plug 64 is glued into the plunger only partially so that an annular space or groove is left, as shown, to accommodate the same "U-cup" type ring seal 66 described above for FIG. 3. On this simplified embodiment, the seal may be replaced without tools by simply pulling the plunger out of the barrel with the bleed valve 11 in the open position.

DESCRIPTION OF FIGS 8 AND 8A

Figure 8:
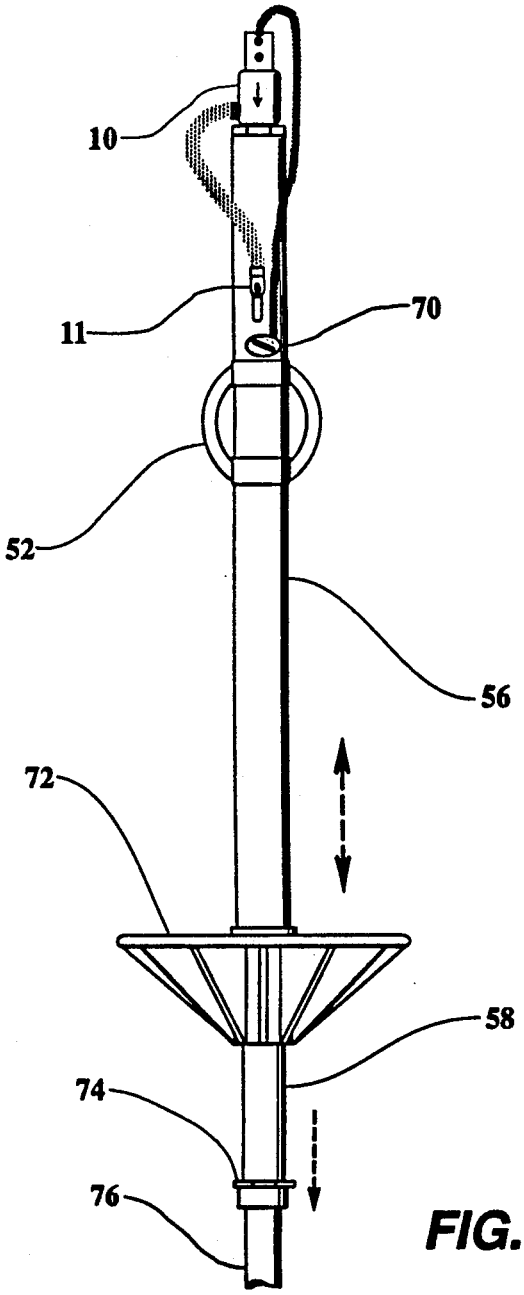
FIG. 8 shows a lightweight, consumer version secured by a stand pipe that inserts into plunger tube.

FIG. 8 shows a lightweight and inexpensive "consumer version" of the invention similar in construction to the "toy version" in FIG. 6, though on a generally larger scale. A stop-collar 74 caps the lower terminus of the plunger tube (58) while leaving the inner diameter open so that it may receive stand pipe 76 which in turn is secured to a fixed plate, stand, or ground. Additionally, the traditional footrest configuration used on earlier models is replaced by a round footrest platform 72 of a molded plastic material (such as structural foam). This design provides a much wider spectrum of possible foot positions (most notably including the capacity to allow the rider to step backwards from the traditional position of straddling the vertical tube, thus affording a much more comfortable and erect position for prolonged exercise). The round design also is safer for obvious reasons, and even allows for the possibility of accommodating more than one rider at one time. This version also utilizes a control lever 70 or dial attached to the aspirating check-valve (10), which adjusts the spring tension on the valve mechanism. One simple modification of this mechanism also produces a "free-fall" capability for the serious or adventurous athlete.

Figure 8A:
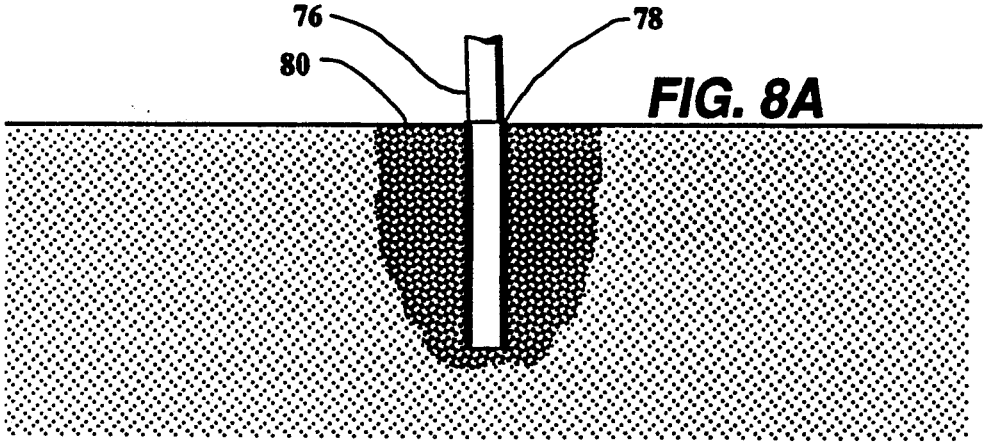
FIG. 8A shows a practical method of securing stand pipe in ground.

FIG. 8A shows a simple and practical method of securing the (tubular) device in a yard, patio, playground, or any such setting, allowing the device to be set up or taken down easily and in a matter of seconds. A receiving tube 78 is set vertically into the ground with its upper end more or less flush with the surface. An optional concrete footing 80 can be poured around the tube for permanent stability, or where a shallower hole is desired. This tube is sized to receive the stand pipe (76) fairly snugly.

DESCRIPTION OF FIG. 9

Figure 9:
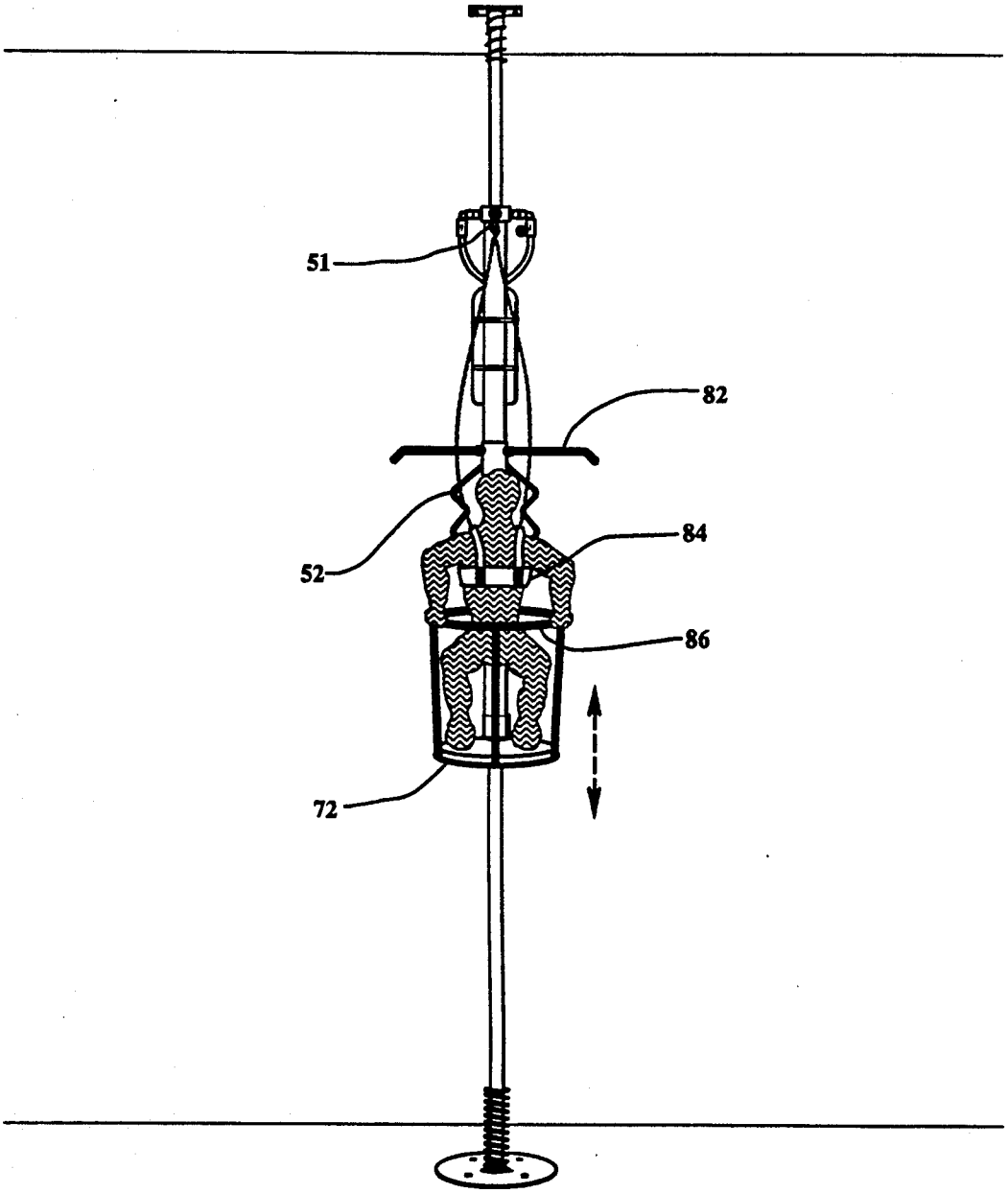
FIG. 9 shows a full-size institutional version with foot platform, body harness, handholds, "lat-pull" bars, safety/dip-rail, and body harness.

FIG. 9 shows a perspective view of a "full size" institutional version during operation. The operator is shown wearing a simple body harness 84 which is attached to the harness attachment ring (51). Doubling as additional safety containment as well as a convenient arm-exercising hand-rail (shown in use) is the safety/-dip-rail 86. Other possibilities for arm/chest/back exercises are provided by handholds 52 and lat-pull bars 82.

THEORY OF OPERATION

The method of operation of these devices is similar to that of most prior-art pogo sticks: the operator's legs provide the motive power in a series of jumps or downward thrusts. The primary difference in operation is that the present concept allows for substantial extension of the apparatus and, consequently, much greater vertical movement. Additionally, in all but one embodiment (the lightweight "toy" version) the lower shaft (plunger) of the device is held in a fixed position so that the jumping efforts of the operator or rider may be directed toward the (greater) vertical movement, being freed from the traditional pogo stick concerns of safety and balance.

The concept of compressing a column of air for use as an air spring is also not new. The novel approach here is the method that produces an extension or lengthening of the air spring as follows: After the energy of the leg's downward thrust compresses the column of air in the cylinder, it then must rebound, or spring back upward with the same energy or total force that was applied to it (less any energy lost to internal friction). A jump or leap is accomplished when more force is applied than needed to overcome the force of gravity. In a conventional pogo stick device, the leap is accompanied by the lower ground-engaging part (plunger) being pulled off the ground as its outward limit of travel is reached. In all but the toy pogo stick version, this airborne tendency is prevented by the fixed nature of the lower shaft of plunger, so that the upward momentum may produce an extension of the air spring, or air cylinder as per the following description.

OPERATION—FIGS. 1-4

The operation is best illustrated using the basic embodiment shown in FIGS. 1 and 2. The reference number 12 (described above) denotes the pneumatic air cylinder, commercially manufactured for use herein as an extendable air spring. In the resting or "fully bled" starting position shown, the weight of the cylinder barrel and accompanying attachments, including the footrest as well as the weight of the operator, all rest on limit spring 18. Interior bumper spring 22 may also be seen in this view through relief porting slots 20 in the lower end of the barrel. The purpose of spring 22 is to soften the contact as the barrel reaches its upper limit of travel against the bottom of the air cylinder's piston. Porting slots 20 vent to atmosphere the pressure produced in secondary chamber 19 (the space inside the cylinder and below the piston—FIG. 3) that would otherwise have a damping or slowing effect on vertical movement.

FIG. 1A shows aspirating check-valve 10 which admits air into the main "working chamber" of air cylinder 12. It is this added volume of air that achieves the lengthening effect on the air cylinder being used here as an air spring. As mentioned in the previous Theory or Operation section, this intake of air is made possible by the upward momentum of both barrel and rider after an energetic leaping effort. Since check-valve 10 is "facing" into the air chamber, it will allow added air to enter the chamber whenever the pressure of the atmosphere exceeds the pressure inside the chamber. This condition is met whenever the barrel (and rider) achieves a greater height, and as the extra elevation of the barrel "pulls" a partial vacuum in the air chamber, air flows in to fill it. In this way, it may be seen that a progressive lengthening of the "air spring" is achieved, which produces the desired elevating effect. Whenever the operator chooses, bleed-valve 11 may be opened, which releases air from the chamber, thereby lowering the apparatus to the desired level.

The operation of the "double end" embodiment shown in FIG. 4 is the same as for the basic version just described, the only different being that check-valve 10 is ported into the side of the upper cylinder head as mentioned in the Description.

OPERATION—FIG. 5

The current preferred embodiment shown in FIG. 5 uses all the features of the basic version (FIGS. 1 and 2) except that the relief porting slots (20—FIG. 2) have been replaced by a standard port that accommodates check-valve 54 faced outward from the secondary air chamber (19—FIG. 3, as described above). This valve expels air each time a higher level is reached, achieving a greater degree of vacuum. This vacuum has the effect of supplementing the "air spring effect" of the main chamber (17—FIG. 3, as described above) by pulling up while the latter is pushing up on the barrel. This effect fortunately increases as greater extension (elevation) is reached, until a "near perfect" vacuum is pulled at the top limit of travel. Since the maximum pressure exerted on this vacuum is only one atmosphere, it needs no bleed valve to enable the descent of the apparatus.

Another important addition contained in this embodiment is the air tank set-up, which provide a more controllable supplementary lift. In order to use this feature, it is necessary to pump up the air pressure in air tank 50 to whatever pressure is desired, with reference to pressure gage 45 provided for that purpose. Since its primary purpose is for use as an exercise device, this embodiment uses leg power to accomplish the pumping up of the air tank in the following manner: With valve 38 from the tank in a closed position and valve 40 into the tank in open position, the air cylinder is in a mode to act as an air pump. The operator merely bounces on limiting spring 18 until the desired pressure is reached. Each time the operator's weight comes down on the spring, the air in the chamber is pressurized so that a portion of it passes through check-valve 43 into the tank. Each time the operator is rebounded back upward by the spring, aspirating check-valve 10 takes in another "gulp" of air that is compressed and forced into the tank, and so on. When the operator chooses, valve 38 is opened and the pressurized air flows through check-valve 42 and into air chamber 17. This has the exhilarating effect of producing an immediate and forceful lift determined by the tank pressure reached and how much and for how long the valve is opened. The operator may choose to use all the pressurized air at one time, or for several smaller lifts, but a descent to the bottom must be made before the tank may again be pumped up to full pressure.

The above described exertions are facilitated and made safer by the presence of handholds 52, as well as harness attachment ring 51. The latter is to be used to secure a body harness if desired by owner or operator, to insure that the operator cannot fall off.

OPERATION—FIGS 6 AND 7

The toy, or unsecured pogo stick version shown in FIGS. 6 and 7 operates on the same principal as the basic embodiment in FIGS. 1 and 2. The significant difference in operation is that the rider must balance and otherwise manage the lateral movement along with the vertical as in the traditional pogo stick concept. The extendable air spring in this case is comprised of two telescoping tubes. The larger, or barrel tube 56 is closed at the top by an adapter bushing 57 that accommodates aspirating check-valve 10 with bleed-valve 11 attached as before. Plunger tube 58 slides inside barrel tube 56 and is also closed at the top by plug 64. The resulting air chamber is effectively sealed by "U-cup" seal 66 as previously described and shown in FIG. 7. For the lower, ground engaging end of the plunger, a choice of two end-tips is provided: end-tip 60 for hard surfaces and end-tip 62 for soft surfaces. Both these tips are sized to be a snug press-fit into the end of the plunger tube.

In order to start a series of jumps, it is necessary to compress a volume of air in the chamber since there is no compression spring to use for start-up on this embodiment. This is easily accomplished before mounting by manually extending the device with the bleed-valve open, then closing the bleed when the desired extension is reached (approximately 50 centimeters). The rider may now step onto the footrest with the resulting compression of the air acting, as previously described, as an air spring. When it is desired for the device to extend in an upward direction, the operator's efforts are directed toward higher leaps, causing the check-valve to take in more air, as previously explained. Bleed valve 11 is used to lower the level of operation as before, except that it now requires judicious use while keeping one's balance. Also, since there is not compression spring as before to soften a rapid descent, the valve must be closed before reaching bottom, unless a dismount is being executed.

Due to the "open barrel" construction of this toy version, it is expected that the U-cup seal will need to be replaced regularly. To do this is a quick and simple task, as the plunger may be easily pulled out of the barrel when the bleed-valve is open, thus making the seal readily accessible. At this time, grease or other lubricant may be applied to reduce wear and increase general efficiency.

OPERATION OF FIGS 8 AND 8A

The operation of the "consumer version" shown in FIG. 8 is similar to the description for FIG. 6 above except that its generally larger size allows for a greater range of vertical motion and elevation. In addition, the fixed or secured nature of this embodiment makes such elevation safely attainable. The basis of this secured nature is provided by a stiff stand pipe 76 or tube that fits easily up inside the plunger tube (58) and is secured to a floor, stand, or into the ground (as shown below). This pipe or tube is cut to a length that allows it to reach almost the full length of the plunger tube so that it serves to stiffen the latter to a degree that minimizes side-sway to an acceptable degree. Stop-collar 74 serves the dual purpose of protecting the exposed end of the plunger tube, as well as keeping the tube from being driven too far into the barrel, which could cause damage also. Also like the "toy" version (FIG. 6), about 50 cm. of extension is required for "start-up", and is obtained similarly by holding the bleed-valve (11) open and lifting the device up to the desired level. The rider then mounts the footrest platform 72 and commences to bounce while gripping the handholds (52). The upward extension, or Ascension is normally automatic with every energetic leaping effort; however, whenever the rider/operator desires to put an upward limit of "ceiling" on his efforts, he may increase the spring tension on the aspirating check-valve (10) by adjusting the check-valve control lever 70 to a stronger tension setting which will stop the admission of more air into the cylinder. It may be mentioned here that with all of the exercise versions of this invention, the rider/exerciser can increase/decrease the level of motion to any desired degree, or stop movement at any time, almost instantly, by merely adjusting the level of exertion accordingly. Also as with the "toy" version, descent is accomplished by opening bleed-valve 11.

The method of using the set-up shown in FIG. 8A consists of simply sliding the stand pipe 76 into the plunger tube 58 while the device is in a horizontal position, then standing the assembly up vertically and inserting the stand pipe into the receiving tube 78. In this way, the set-up and take-down are not only easy and quick, but nothing is left protruding above the ground level.

SUMMARY, RAMIFICATIONS, AND SCOPE

Thus it may be seen that this concept provides highly desirable forms of exercise and recreation for adults and/or children as well as equipment for preferred use in gymnasiums, health clubs, playgrounds, hotels, amusement facilities, etc. It also has additional advantages in that

- it utilizes the highly developed art of commercial air cylinder technology;
- it provides a device that is entirely self-contained and human powered;
- it provide a safe, secured rebounding exercise device;
- it exercises many muscle groups, including arms, back, chest, and abdominals, as well as leg muscles to an aerobic degree;
- it provides an exercising device with an exhilarating degree of elevating capacity;
- it provides high-flying capabilities for an amusement park device, as the elevating capacity is limited by the size of the equipment used;
- it provides for a lightweight, inexpensive, and fun to use pogo stick type jumping toy; and
- it provides basic concepts that can be utilized in a great variety of ramifications, and combinations thereof.

Although my above descriptions contain many specifications, these are not to be construed as limitations on the scope of the invention, but rather as examples of a few currently favored embodiments. Many other variations are possible. For example, the size of the air cylinder could be greatly increased for amusement part type use and a larger diameter hollow rod used, either for introduction of compressed air from a remote source, or as the air reservoir in a self-contained version. Also, there are a great number of companies that produce quality air cylinders of many types and designs, allowing a broad choice of approaches to the concept. It also seems obvious to this inventor that in the area of controls, especially, there are great improvements that can be made within the scope and spirit of this invention. My present plan in this area is to pursue the idea of using air-actuated valving for the air reservoir on the preferred embodiment. This would enable the use of push-button controls, so that the operator's hands could both remain on the handholds at all times. Other planned tests include increasing the cylinder bore to approximately 100 mm. (4 in.) on the preferred embodiment. This may prove to add more versatility in degree of exertion, ease of operation, etc. Also, different materials may be used for many of the components. For example, the toy version may ultimately utilize metal tubing to provide greater durability, etc.

[Continuation Note: Since the writing of the original specification, the idea of computerized controls (especially for the larger institutional embodiments such as that shown in FIG. 9) has shown great appeal, and could simplify the operation, as well as the design of the controls themselves. The computer could be powered by a tiny air-powered turbine/generator run off the air tank, and could provide directions and operator feedback as well as push-button controls. Additionally, a possible improvement to the consumer version (FIG. 8) may be made necessary by the fact that the present prototype works so well that it is possible to rebound on the device right up to its limit of around 2 meters. A 2.5 meter unit is under development at this time, but a travel-limiting safety mechanism may need to be developed, and would probably consist of a threaded retaining collar screwed onto the lower end of the barrel tube (possibly also housing a wiper-ring) that would, due to the strategic attachment of a stop-ring (/wear-ring combination) to the plunger, keep the upper 30–50 cm. of the plunger from extending from the barrel. Also, at some future point, the basic (FIG. 1) version could be modified to require much less headroom. This could easily be accomplished by inverting the layout, and instead of securing the rod, as before, securing the barrel, under the floor level, with the footrest, handholds, etc. attached to the upper portion of a longer rod, which could be of a larger diameter (for stiffness) and of a hollow construction in order to keep the weight down, as well as provide a convenient channel for control wire(s), etc. which could thus connect directly to a valve in the piston, etc.]

The possible variations of the concepts herein contained are manifold. Accordingly, the scope of the invention should be determined not by the embodiments illustrated, but by the appended claims and their legal equivalents.

I claim:

1. An elevating rebounding exercise device or extendable pogo stick, comprising:

(a) a pneumatic air cylinder to be used as an air spring by the method of utilizing stored energy in a compressed column of air to provide an outward biasing force, said air cylinder being vertically disposed, with barrel above and rod or plunger member protruding below, and having footrest means for a human operator located on the lower portion of said barrel; and (b) aspirating valve means connected to working air chamber of said air cylinder for the purpose of allowing the variation, during jumping efforts by the human operator, of the volume of air in said air chamber, thereby controlling the amount of lengthening or extension of said rod from said barrel, and the consequent elevation of said barrel along with said operator.

2. The elevating rebounding exercise device of extendable pogo stick of claim 1 wherein said valve means includes check valve means for facilitating the introduction of atmospheric air into said air chamber for the purpose of extending said rod and thus elevating said barrel and operator, and further including bleed valve means to facilitate the descent of said barrel and operator.

3. The elevating rebounding exercise device or extendable pogo stick of claim 2 wherein the stroke length of said air cylinder is greater than the approximate height of a predetermined rider or operator, and the effective bore diameter is approximately 6 to 16 centimeters.

4. The elevating rebounding exercise device or extendable pogo stick of claim 2 wherein said check valve means includes control means for selectively adjusting the amount of pressure differential required to actuate said check valve, whereby the extension and contraction of said rod is rendered controllable.

5. The elevating rebounding exercise device or extendable pogo stick of claim 2 wherein said footrest means includes a footrest platform that extends horizontally outwards from the vertical axis in such a way as to allow a comfortable standing space for at least one human operator with two feet placed at an adequate distance from said axis to allow the gravitational center of said operator to be directly above said feet, possibly further including a safety dip rail at the approximate hip level of said operator and surrounding the space directly above said footrest platform at a distance so as to be conveniently graspable by said operator.

6. The elevating rebounding exercise device or extendable pogo stick of claim 5 wherein said footrest platform extends substantially around the circumference of the main axial member, whether it be barrel, rod, tube, or shaft, whereby space for moving about said axis is provided to the operator, as well as the possibility of accommodating a plurality of human operators.

7. The elevating rebounding exercise device or extendable pogo stick of claim 3 wherein said rod of said air cylinder is connected to a piston at its upper end, said piston being of a larger diameter than said rod and thus defining a secondary air chamber around said rod and between the bottom of piston and bottom end part of barrel, and further including sufficient pressure relief porting or opening in bottom portion of barrel to prevent noticeable damping action, by venting to atmosphere said secondary air chamber.

8. The elevating rebounding exercise device or extendable pogo stick of claim 7 wherein said pressure relief porting is utilized as valve porting, being fitted with appropriate valve means so as to permit utilization of said secondary air chamber as a supplementary air spring in similar manner as delineated above for said primary, or working air chamber.

9. The elevating rebounding exercise device or extendable pogo stick of claim 8, further including limiting spring means of a capacity sufficient to easily bear the combined weight of barrel and operator, and being situated between said supporting surface or stand and bottom end of barrel so as to facilitate the initiation of a series of jumps, as well as to provide a cushioning effect for any rapid descent.

10. The elevating rebounding exercise device or extendable pogo stick of claim 9, further including safety harness attachment means for securing said operator to said barrel, whereby the device is made safe enough for commercial use, such as in gyms, health clubs and amusement parks.

11. The elevating exercise device or extendable pogo stick of claim 10, further including handhold means attached to barrel, whereby an operator's stability is enhanced, and upper body exercise is further facilitated.

12. The elevating rebounding exercise device or extendable pogo stick of claim 11, further including reservoir means for storing pressurized air, said reservoir means being connected to said working air chamber by air exchange means, said air exchange means including control valve means for exclusively limiting the air flow and direction three ways with respect to said reservoir means, namely: in, out, or off; by this arrangement, the reservoir may be pumped up at will by the efforts of the operator, and the resulting pressurized air available for added lift at the discretion of the operator.

13. The elevating rebounding exercise device or extendable pogo stick of claim 10 wherein said air cylinder is of the double end type, having the rod protruding through the top end of the barrel as well as the bottom end, and with the piston mounted substantially half way between rod ends, whereby the uppermost rod end may be secured to any convenient architectural element such as wall or ceiling, thus substantially reducing the lateral bending forces on the lowermost rod end.

14. The elevating rebounding exercise device or extendable pogo stick of claim 10 wherein said rod contains a bore running its length for use as an air exchange passage to said working air chamber, whereby remote pressurized air and valve means may be used to control pressure and volume levels in one, or in a plurality of said devices for use in amusement type applications.

15. A pneumatically extendable gas spring comprising:

(a) an elongate tubular cylinder of barrel situated in a generally vertical position, having an axis and defining a cavity therein;

(b) a plunger member extending downwardly and telescopically upwardly and inwardly of said cavity, said barrel in combination with said plunger thus defining a working air chamber within said cavity, said plunger member being slidingly and sealingly movable inwardly and outwardly of said cavity, the axial position of said plunger member in relation to said barrel being responsive to the force or pressure exerted on the resulting column of air from without, and to the volume of air within said air chamber, wherein said barrel has a bore diameter in the approximate range of 5 to 10 centimeters and barrel length equal to at least the approximate height of a predetermined operator;

(c) air exchange valve means for selectively increasing and decreasing the volume of air confined in said air chamber, thus affecting the amount of extension and retraction, respectively, of said plunger member relative to said barrel, wherein said valve means includes check valve means, positioned so as to allow air into said air chamber when air pressure on inlet side of said check valve exceeds the air pressure within said chamber, thus achieving extension of said gas spring and the consequent elevation of said operator; and (d) footrest means on the lower outside portion of said barrel, whereby said gas spring is made suitable for use as a pogo stick with variable height control.

16. The pneumatically extendable gas spring of claim 15 wherein said valve means includes bleed valve means to facilitate retraction of said gas spring, said check valve is open to atmosphere on inlet side, and said gas spring is constructed in a simple and lightweight manner with commonly available materials so as to be suitable, safe, and inexpensive as a pogo stick jumping toy for children or adults.

17. The pneumatically extendable gas spring of claim 16 wherein said plunger member is provided with a plurality of resilient ground engaging tips in a variety of sizes and resilient properties, and that are attachable to its lower terminus, one at a time, so as to provide a selection of said tips to match the surface conditions encountered.

18. The pneumatically extendable gas spring of claim 16 wherein said gas spring includes means for fixing said plunger member securely and at a generally perpendicular angle to ground or floor surface, whereby said device is made suitable and safe for sustained use as a stationary rebounding exercise device.

19. The pneumatically extendable gas spring of claim 18 wherein said plunger member is of a tubular construction, thus allowing the insertion of a stand pipe, rod, or tube up into its hollow center, thus acting as said means for fixing said plunger member securely to ground, floor, or stand.

20. A stationary, gas spring actuated rebounding exercise device comprising:

(a) an elongated tubular cylinder or barrel situated in a generally vertical position, having an axis and defining a cavity therein;

(b) a plunger member extending outwardly and telescopically inwardly of said cavity, said barrel in combination with said plunger thus defining a working air chamber within said cavity, said plunger member being slidingly and sealingly movable inwardly and outwardly of said cavity, the axial position of said plunger member in relation to said barrel being responsive to the force or pressure exerted on the resulting column or air without, and to the volume of air within said air chamber;

(c) footrest means and handhold means for a human operator;

(d) air exchange valve means for selectively increasing and decreasing the volume of air confined in said air chamber, affecting the amount of extension and retraction, respectively, of said plunger member relative to said barrel, thus achieving extension of said gas spring and the consequent elevation of said operator; and (e) means for securing said gas spring actuated rebounding device to a stand, floor, or ground surface, whereby said device is made suitable and safe for use as a stationary rebounding exercise device.

* * * * *

UNITED STATES PATENT AND TRADEMARK OFFICE

CERTIFICATE OF CORRECTION

PATENT NO. : 5,087,037

DATED : February 11, 1992

INVENTOR(S) : George S. Morrow

It is certified that error appears in the above-identified patent and that said Letters Patent is hereby corrected as shown below:

Col. 2, line 15, delete "or elevated". Col. 2 line 29, change "ground (to floor or" to --(to ground, floor or--. Col. 4, line 34, change "unit" to --nut--. Col. 7, line 15, change "leg's" to --legs'--. Col. 7, line 55, change "or" to --of--. Col. 8, line 27, change "provide" to --provides--. Col. 9, line 27, change "not" to --no--. Col. 9, line 64, change "of" to --or--. Col. 10, line 35, after "limited" insert --only--. Col. 11, line 57, change "of" to --or--. Col. 12, line 46, change "8" to --7--. Col. 12, line 59 after "elevating" insert --rebounding--. Col. 13, line 24, change "elongate tubular cylinder of" to --elongated tubular cylinder or--. Col. 14, line 41, change "or air without" to --of air from without--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*